US008117883B2

(12) United States Patent
Simpson et al.

(10) Patent No.: US 8,117,883 B2
(45) Date of Patent: Feb. 21, 2012

(54) TUBING EXPANSION

(75) Inventors: Neil Andrew Abercrombie Simpson, Aberdeen (GB); Wayne Rudd, Ponteland (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 12/718,811

(22) Filed: Mar. 5, 2010

(65) Prior Publication Data

US 2010/0218582 A1 Sep. 2, 2010

Related U.S. Application Data

(63) Continuation of application No. 10/809,036, filed on Mar. 25, 2004, now abandoned.

(30) Foreign Application Priority Data

Mar. 25, 2003 (GB) ..... 0306774.1
May 29, 2003 (GB) ..... 0312278.5

(51) Int. Cl.
*B21D 39/08* (2006.01)
*E21B 29/00* (2006.01)

(52) U.S. Cl. ..... 72/370.06; 72/58; 166/384

(58) Field of Classification Search ..... 72/54, 56, 72/58, 710, 370.06; 166/207, 212, 380, 384
See application file for complete search history.

(56) References Cited

U.S. PATENT DOCUMENTS 1,561,418 A 11/1925 Duda
1,569,729 A 1/1926 Duda
1,597,212 A 8/1926 Spengler
2,096,234 A 10/1937 Erwin
2,383,214 A 8/1945 Prout
2,627,891 A 2/1953 Clark
2,919,741 A 1/1960 Strock et al.
3,212,313 A 10/1965 Boyd et al.
3,224,086 A 12/1965 Balamuth
3,643,485 A 2/1972 Marcovitch
3,818,734 A 6/1974 Bateman
3,867,291 A * 2/1975 Schmidt et al. ..... 210/139
4,058,163 A 11/1977 Yandell
4,204,312 A 5/1980 Tooker
4,384,625 A 5/1983 Roper et al.
4,483,399 A 11/1984 Colgate
4,619,129 A 10/1986 Petkov et al.
4,890,682 A 1/1990 Worrall et al.
5,031,699 A 7/1991 Artynov et al.
5,042,385 A 8/1991 Reed, Jr. et al.

(Continued)

FOREIGN PATENT DOCUMENTS

EP 0 041 835 12/1981

(Continued)

OTHER PUBLICATIONS

GB Search Report dated Jul. 22, 2003, from GB Application No. 0306774.1.

(Continued)

*Primary Examiner* — Debra Sullivan

(74) *Attorney, Agent, or Firm* — Patterson & Sheridan, L.L.P.

(57) ABSTRACT

A method of expanding tubing comprises locating an expansion device in tubing to be expanded, vibrating one or both of the tubing and the expansion device, and translating the expansion device relative to the tubing, the vibration acting to reduce friction between the tubing and the device.

17 Claims, 3 Drawing Sheets

U.S. PATENT DOCUMENTS

| | | | | |
|---|---|---|---|---|
| 5,083,608 | A | 1/1992 | Abdrakhmanov et al. | |
| 5,513,709 | A | 5/1996 | Fisher | |
| 6,012,522 | A | 1/2000 | Donnelly et al. | |
| 6,142,230 | A | 11/2000 | Smalley et al. | |
| 6,263,968 | B1 | 7/2001 | Freeman et al. | |
| 6,390,201 | B1 | 5/2002 | Coon et al. | |
| 6,419,025 | B1 | 7/2002 | Lohbeck et al. | |
| 6,446,323 | B1 | 9/2002 | Metcalfe et al. | |
| 6,457,532 | B1 | 10/2002 | Simpson | |
| 6,543,552 | B1 | 4/2003 | Metcalfe et al. | |
| 6,568,472 | B1 | 5/2003 | Gano et al. | |
| 6,571,870 | B2 | 6/2003 | Zheng et al. | |
| 6,575,250 | B1 | 6/2003 | Wijsman | |
| 6,595,296 | B1 | 7/2003 | French | |
| 6,695,065 | B2 | 2/2004 | Simpson et al. | |
| 6,712,151 | B2 * | 3/2004 | Simpson et al. | 166/384 |
| 6,907,927 | B2 | 6/2005 | Zheng et al. | |
| 6,976,536 | B2 | 12/2005 | Simpson et al. | |
| 7,350,585 | B2 | 4/2008 | Simpson et al. | |
| 2002/0139540 | A1 | 10/2002 | Lauritzen | |
| 2004/0094312 | A1 | 5/2004 | Lohbeck et al. | |
| 2004/0216506 | A1 | 11/2004 | Simpson et al. | |
| 2005/0145390 | A1 * | 7/2005 | Burge | 166/380 |
| 2006/0108123 | A1 | 5/2006 | De Lucia et al. | |

FOREIGN PATENT DOCUMENTS

| | | |
|---|---|---|
| EP | 0 952 306 | 10/1999 |
| GB | 1 349 134 | 3/1974 |
| GB | 2 088 438 | 6/1982 |
| GB | 2 261 238 | 5/1993 |
| GB | 2 272 924 | 6/1994 |
| GB | 2 401 134 | 4/2006 |
| WO | WO 98/00626 | 1/1998 |
| WO | WO 00/37766 | 6/2000 |
| WO | WO 02/14028 | 2/2002 |
| WO | WO 02/073000 | 9/2002 |
| WO | WO 02/081863 | 10/2002 |
| WO | WO 02/090713 | 11/2002 |
| WO | WO 02/103150 | 12/2002 |
| WO | WO 03/015954 | 2/2003 |
| WO | WO 03/048503 | 6/2003 |
| WO | WO 03/064813 | 8/2003 |

OTHER PUBLICATIONS

GB Search Report dated Sep. 18, 2003, from GB Application No. 0312278.5.

GB Search Report dated Apr. 29, 2004, from GB Application No. 0406520.7.

GB Search Report dated Jun. 11, 2004, from GB Application No. 0406693.2.

GB Search Report dated Jun. 17, 2004, from GB Application No. 0406694.0,.

* cited by examiner

TUBING EXPANSION

CROSS-REFERENCE TO RELATED APPLICATIONS

This application is a continuation of U.S. patent application Ser. No. 10/809,036, filed Mar. 25, 2004, which claims benefit of Great Britain patent application serial number GB 0306774.1, filed Mar. 25, 2003, and Great Britain patent application serial number GB 0312278.5, filed May 29, 2003. Each of the aforementioned related patent applications is herein incorporated by reference.

BACKGROUND OF THE INVENTION

1. Field of the Invention

This invention relates to tubing expansion. In particular, but not exclusively, the invention relates to diametric expansion of tubing downhole.

2. Description of the Related Art

One of the most significant recent developments in the oil and gas exploration and production industry has been the introduction of technology which allows for expansion of extended sections of tubing downhole. The tubing may take different forms, including but not restricted to: expandable casing, liner, sandscreen, straddles, packers and hangers. A variety of expansion methods have been proposed, including use of expansion cones or mandrels which are forced through the tubing. One difficulty which has been experienced with cone expansion is the high level of friction and wear between the surface of the cone and the inner surface of the tubing to be expanded.

It is among the objectives of embodiments of the present invention to obviate or mitigate this difficulty.

SUMMARY OF THE INVENTION

According to the present invention there is provided a method of expanding tubing, the method comprising:

locating an expansion device in tubing to be expanded;

vibrating at least one of the tubing and the expansion device; and translating the expansion device relative to the tubing.

The vibration of at least one of the tubing and the expansion device preferably acts to reduce friction between the tubing and the device.

In conventional tubing expansion operations an expansion device which slides relative to the tubing to be expanded, such as a cone or mandrel, will tend to progress through the tubing incrementally in a series of small steps. From a static condition, the load on the cone is increased until the load is sufficient to drive the cone through the tubing. In addition to the forces required to expand the tubing diametrically, it is also necessary to overcome the static friction between the contacting surfaces of the cone and the tubing before the cone will move relative to the tubing. Once static friction has been overcome, frictional resistance to movement typically decreases sharply due to the lower dynamic friction between the contacting surfaces, such that the initial movement of the cone will tend to be relatively rapid. As the cone moves forward rapidly relative to the tubing, the driving force being applied to the cone will tend to fall, the inertia of the cone-driving arrangement being such that the cone-driving arrangement will typically fail to keep pace with the cone. Thus, after the initial rapid movement, the cone will tend to stall as the driving force decreases. The driving force applied to the cone then increases once more, moving the cone forward again once static friction between the cone and tube is overcome. For brevity, this form of movement will hereinafter be referred to as "stick-slip".

With the present invention, the vibration of one or both of the expansion device and the tubing is intended such that there will be little or no static friction experienced between the contacting surfaces, and the conventional stick-slip progression of the expansion device relative to the tubing should be avoided. The driving force necessary to drive the expansion device through the tubing should therefore remain relatively constant, as the frictional forces remain at a relatively constant, and relatively low, level.

Furthermore, the reduction in friction between the expansion device and the tubing should tend to decrease the wear experienced by the expansion device, which in conventional expansion operations may place limits on the length of tubing which can be expanded in a single expansion operation.

Of course, in downhole applications, the vibration may also serve to assist in reducing the occurrence of differential sticking between the tubing and the surrounding bore wall.

The frequency and amplitude of vibration may be selected to suit each particular application. Furthermore, the direction of vibration may be selected as appropriate: for example, the vibration may be random, multi-directional, axial, transverse or rotational. In one embodiment of the invention the vibration is substantially perpendicular to the surface of the expansion device, and in another embodiment the vibration takes the form of torsional oscillations.

Where the expansion device is vibrated, all or a major portion of the device may be subject to vibration. Alternatively, only a selected portion of the device may be subject to vibration, for example only a surface portion of the device, or only a selected area of the surface of the device, may be subject to vibration. Portions of the expansion device may also experience different degrees or forms of vibration.

If the tubing is vibrated, all or a substantial portion of the tubing may be vibrated. Alternatively, only a selected portion of the tubing may be vibrated. For example, only a portion of the tubing at or adjacent the expansion device may be vibrated, or only a surface portion of the tubing may be vibrated.

The vibration of the expansion device or tubing may induce physical movement of the device or tubing. Alternatively, or in addition, the vibration of the device or tubing may induce contraction and expansion of all or a portion of the device or the tubing. For example, the vibration may take the form of one or more waves traveling through the device or tubing.

The vibration of the expansion device or tubing may induce physical movement of the device or tubing. Alternatively, or in addition, the vibration of the device or tubing may induce contraction and expansion of all or a portion of the device or the tubing. For example, the vibration may take the form of one or more waves traveling through the device or tubing.

The vibration may be induced or created locally relative to the expansion device or the tubing being expanded, or may be created remotely, for example a wave form oscillation may be created remote from the expansion device location, and then travel along or through the tubing wall, or travel to the expansion location via another medium.

The vibration may be created by any appropriate means, including: an oscillating or otherwise moving mass; creating a varying or cyclic restriction to fluid flowing through the expansion device or tubing; an electromagnetic oscillator; varying the pressure of fluid operatively associated with the device or tubing; creating pressure pulses in a fluid; or injecting gas or liquid or a mixture of both into fluid operatively associated with the device or tubing.

The source of vibration or oscillation may be directly or indirectly coupled to one or both of the expansion device and the tubing.

The vibration may be of a constant, varying or substantially random nature, that is the amplitude, direction, frequency and form of the vibration may be constant, varying or random.

The vibration or oscillation may be of high frequency, for example ultrasonic. Such vibration may not be apparent as physical movement, as the vibration may be at a molecular or macromolecular level, or at least at a level below that of readily detectable physical movement of the device or tubing. Such vibration may be induced electromagnetically, for example by a varying electromagnetic field, or a varying or alternating current or voltage. Alternatively, or in addition, the vibration or oscillation may be of relatively low frequency, for example in the range of 1 to 100 Hz. If desired, the vibration may comprise a plurality of different components, for example a low frequency component and a high frequency component.

The vibration may be selected to coincide with a natural frequency of the expansion device or the tubing, or another element of apparatus. Alternatively, the vibration may be selected to avoid such natural frequency or frequencies.

The expansion device may be translated relative to the tubing by any appropriate means. The device may be mounted on a support which allows the device to be pushed, pulled or otherwise driven through the tubing. The support may extend from a downhole location to surface, where a pushing, pulling or torsional force may be applied. Alternatively, the expansion device may be coupled to a tractor or other driving arrangement located downhole. Alternatively, or in addition, fluid pressure may be utilised to move the device relative to the tubing.

The expansion device may take any appropriate form and may utilise any appropriate expansion mechanism, or a combination of different expansion mechanisms. An expansion cone or mandrel may be utilised with an expansion surface adapted for sliding or rolling contact with the tubing wall. The cone may be adapted for axial movement relative to the tubing, but may also be adapted for rotation. Alternatively, or in addition, a rotary expander may be utilised, that is a device which is rotated within the tubing with at least one expansion member, typically a roller, moving around the surface of the tubing and creating localised compressive yield in the tubing wall, the resulting reduction in wall thickness leading to an increase in tubing diameter.

The expansion device may define a fixed diameter, or a variable diameter. The device may be compliant, that is the device has a degree of flexibility to permit the device to, for example, negotiate sections of the tubing which cannot be expanded to a desired larger diameter or form. Alternatively, the expansion device may define a fixed diameter and may be non-compliant. In certain embodiments, the expansion device may feature both fixed and compliant elements.

References herein to expansion are primarily intended to relate to diametric expansion achieved by thinning of tubing wall. However, embodiments of the invention may also relate to tubing which is expanded by reforming a tubing wall, for example by straightening or smoothing a corrugated tubing wall, or other expansion mechanisms.

In other embodiments of the invention the expansion process may be supplemented by the application of an elevated fluid pressure, and in particular a varying fluid pressure, to the tubing.

The varying fluid pressure preferably acts across the wall of the tubing. The variation in pressure may be achieved by any appropriate means, and one or both of the fluid pressure within the tubing and the fluid pressure externally of the tubing may be varied. A body of varying volume may be located in a volume of fluid operatively associated with the tubing. Alternatively, or in addition, the volume of a body of fluid operatively associated with the tubing may be varied by movement of a wall portion defining a boundary of the volume, which wall portion may be operatively associated with an oscillator or a percussive or hammer device. In other embodiments a pressurised fluid source may be provided, and the fluid may be supplied at varying pressure from the source or the manner in which the fluid is delivered to the tubing from the source may be such as to vary the fluid pressure. An increase in pressure within the tubing may be accompanied by a reduction in pressure externally of the tubing, or a reduction of pressure externally of the tubing may occur independently of any variations in the internal pressure, which may remain substantially constant.

In one embodiment, in a downhole application, the fluid pressure externally of the tubing may be maintained at a relatively low level by providing a relatively low density fluid externally of the tubing. Thus, the hydrostatic pressure produced by the column of fluid above the tubing will be relatively low. This may be achieved by injecting gas or low density fluid into fluid surrounding the tubing. Alternatively, or in addition, a volume of fluid externally of the tubing may be at least partially isolated from the head of fluid above the tubing, for example by means of a seal or seals between the tubing and a surrounding bore or tubing wall, or by providing pumping means above the tubing.

Alternatively, or in addition, the fluid pressure internally of the tubing may be maintained at a relatively high level by providing a relatively high density fluid internally of the tubing.

Tubing expansion operations are typically carried out using conventional, readily available fluids, such as seawater or completion brine, which may have a specific gravity (SG) of approximately 1.025. However, the SG of fluids used in downhole operations of course varies depending on, for example, the choice of base fluid and the presence of weight materials or other additives, and may range from 0.85 to 2.2. Thus, references herein to high and low density fluids should be related primarily to fluids utilised in conventional tubing expansion operations and other downhole operations where the fluid is selected with reference primarily to other requirements, including availability and ease of handling. Accordingly, by way of example, with reference to expansion operations which, using conventional expansion techniques, would be carried out in the presence of completion brine, a high density fluid may be one having an SG in excess of around 1.025 and a low density fluid may be one having an SG less than around 1.025. In other cases, the density of a fluid present within tubing to be expanded may be considered to be relatively high if the fluid has been selected with reference to the lower density of the fluid in the annulus surrounding the tubing. Similarly, the density of a fluid in the annulus may be considered to be relatively low if the density is lower than the density of the fluid present within the tubing to be expanded. Of course the invention is not limited to use with liquids, and in some cases one or both of the fluids, particularly where a lower density fluid is required, may be a gas such as natural gas or air, or a multiphase fluid.

The portion of tubing to be expanded may be isolated from ambient fluid by one or more appropriate seals, and a varying pressure differential may be maintained across each seal. However, in accordance with a further aspect of the invention a degree of leakage past the seals may be permissible, and in some cases may even be desirable, particularly if means for providing or creating a cycling fluid pressure is being utilised; if the frequency or rate of pressure variation is sufficiently high, a degree of leakage, and the corresponding pressure decay, will not adversely affect the expansion process and may assist in providing the desired pressure cycling when combined with an appropriate source of pressure. In particular, the method may include the step of producing a pressure pulse, and thus an elevated fluid pressure, which then reduces or decays, as leakage occurs across the seal. Furthermore, the ability to utilise "leaky" seals tends to facilitate use of the expansion method, as there are difficulties involved in providing a fully effective seal in many environments: when expanding tubing downhole, the tubing will often not be perfectly cylindrical, and the tubing diameter may be variable; the tubing surface is unlikely to be perfectly smooth, and may include profiles; the ambient fluid in the tubing may contain particulates and contaminants; and in preferred embodiments the seal will move relative to the tubing as the tubing is expanded, which movement would of course result in wear to one or both of the seal and the tubing, and which movement would have to overcome friction, which could be considerable if a leak-free seal was provided or required. Also, the leakage of fluid around and over the seal will provide lubrication, facilitating relative movement between the seal and the tubing.

The seal may take any appropriate form, but is preferably in the form of a labyrinth seal. Typically, the seal comprises a plurality of seal members, each seal member adapted to maintain a proportion of the total pressure differential across the seal. The number of seal members may be selected depending upon a number of considerations, including the form of the seal members, tubing form and condition, ambient conditions, the pressure differential to be maintained, tubing diameter, and the frequency or rate of variation of the fluid pressure. Of course such a seal configuration may also be suitable for use in situations where the fluid pressure is substantially constant, or is maintained above at least a minimum level, provided of course that means is provided for maintaining the expansion pressure at the desired level, despite leakage past the seal. Thus, perhaps five, ten, fifteen or more seal members may be provided, as appropriate. The number of seal members may be selected to provide for redundancy, such that failure or damage of one or more seal members will not adversely affect the expansion process.

The fluid pressure may be maintained at a base pressure, for example at 70% of the yield pressure of the wall of the tubing, upon which base pressure additional pressure pulses or spikes are superimposed, taking the fluid pressure to or in excess of 100% of the yield pressure, to induce plastic deformation of the tubing.

The mechanical expansion or reforming device, such as an expansion cone, mandrel or die, or a rotary expansion device, may exert only a small expansion force, and may merely serve to stabilise the expansion process and assist in achieving a desired expanded form, for example achieving a desired expanded diameter and avoiding ovality. Alternatively, or in addition, the mechanical expansion or reforming device may serve to retain expansion induced by the elevated fluid pressure. In one embodiment, a shallow angle cone may be advanced through the expanding tubing, the cone preferably being advanced in concert with the periods of elevated pressure. The cone angle may be selected depending upon the particular application, but for downhole tubulars of conventional form it has been found that an 11 degree cone angle results in a cone which retains expansion, that is the cone may be advanced into the tubing expanded by the elevated pressure, and is then retained in the advanced position as the tubing contracts on decay of the fluid pressure below the tubing wall yield pressure. It is anticipated that by cycling the fluid pressure at a rate of around 5 Hertz the cone will advance at a rate of approximately 6 to 8 feet per minute. Of course the rate or frequency of fluid pressure variation may be selected to suit local conditions and equipment. Such advancement may be achieved by providing separate mechanical drive means but may be conveniently achieved by virtue of the pressure differential over a seal coupled to the cone; as the pressure peaks, causing expansion of the tubing, the axial differential pressure acting force across the seal will also peak. Where the cone is located between seals, in particular a leading seal and a trailing seal, the leading seal may be mounted on the cone or otherwise coupled to the cone such that any pressure differential across the seal will tend to urge the cone forward. The trailing seal may be located at some point behind the cone, such that the cone is located within an isolated fluid volume between the seals. The trailing seal may be fixable or securable relative to the tubing or may be floating. The trailing seal may be retained in position mechanically or, alternatively or additionally, by fluid pressure, for example by a column of fluid above the seal, which column may be pressurised by appropriate pumps on surface. The variations in pressure are preferably applied to the isolated fluid volume between the seals, and may be created by a pulse generator located within the isolated volume, or by supplying elevated pressure fluid or pressure pulses from a source externally of the isolated volume. In other embodiments, variations in pressure may also be applied to one or both of the fluid volumes above and below the isolated volume.

Of course the presence of fluid will facilitate movement of any expansion device present relative to the tubing, in particular by serving as a lubricant between the contacting surfaces of the expansion device and the tubing. The fluid may be selected for its lubricating properties. This is particularly the case in embodiments where the fluid surrounding the expansion device is at least partially isolated from the ambient fluid, and as such a smaller volume of fluid selected for its particular properties may be provided. Leakage past isolating seals may be accommodated by providing a larger initial volume, or by supplying further fluid to the volume. Of course the fluid may be selected with properties other than lubrication in mind, for example the fluid may comprise or include a relatively viscous element, for example a grease, to minimize the rate of leakage and pressure decay. Downhole expansion may be accomplished either top down or bottom up, that is expansion process moves downwardly or upwardly through the tubing.

BRIEF DESCRIPTION OF THE DRAWINGS

These and other aspects of the present invention will now be described, by way of example, with reference to the accompanying drawing drawings.

DETAILED DESCRIPTION OF THE PREFERRED EMBODIMENT

Figure 1:
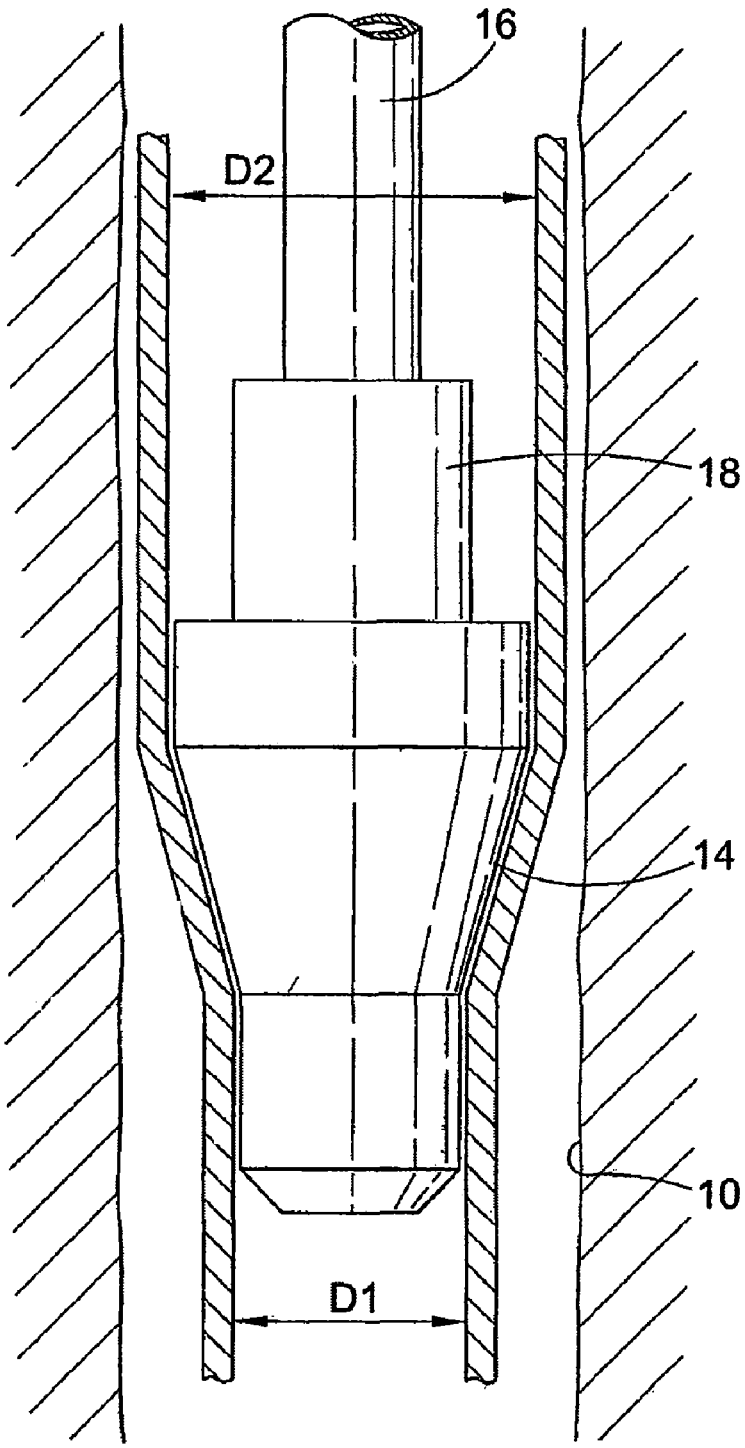
FIG. 1 a schematic illustration of a tubing expansion operation, in accordance with an embodiment of the present invention.

The figure illustrates a subterranean bore 10, such as may be drilled to gain access to a subsurface hydrocarbon reservoir. After drilling, the bore 10 may be lined with metal tubing, sometimes known as liner or casing. In the illustrated embodiment, a section of expandable casing 12 has been run into the bore 10, and once located in the bore 10 the casing 12 is expanded from a smaller first diameter D1 to a larger second diameter D2.

The expansion is achieved by means of driving an expansion cone 14 down through the casing 12, the cone 14 being mounted on a string of drill pipe 16 which extends to surface. The force necessary to drive the cone 14 through the casing 12 while expanding the casing 12 is considerable: the force must be sufficient to deform the casing 12 and also to overcome the friction between the contacting surfaces of the cone 14 and the casing 12. In conventional cone expansion operations the level of friction experienced is such that the cone 14 will tend to progress with an inefficient stick-slip movement, due in part to the differences in static and dynamic friction experienced by the cone 14 as it is moved through the casing 12. However, in the present invention, this difficulty is substantially avoided due to the vibration of the cone 14 by means of an oscillator 18 mounted to the cone 14. In use, the oscillator 18, which is powered from surface via an appropriate control line, produces oscillations at ultrasonic frequencies, which vibrations or oscillations are transferred to the cone 14. This high frequency of vibration of the cone 14 is such that there is substantially constant relative movement between the contacting surfaces of the cone 14 and the casing 12, such that there is no static friction experienced between the contacting surfaces. Thus, the level of friction between the cone 14 and the casing is relatively low, allowing the cone 14 to progress through the casing 12 at a relatively constant rate, in response to a relatively constant applied force.

It will be apparent to those of skill in the art that the above-described embodiment is merely exemplary of the present invention, and that various modifications and improvements may be made thereto without departing from the scope of the present invention.

In other embodiments, the casing 12 rather than the cone 14 may be vibrated, and the manner in which the vibration or oscillation is created may be varied. For example, fluid may be pumped through the drill pipe 16 and the fluid flow path may be interrupted or varied to induce vibration. Alternatively, a stream of gas may be injected into the fluid surrounding the cone 14, causing vibration of one or both of the cone 14 and the casing 12.

In other embodiments of the invention translation of the cone 14 through the casing may be achieved at least in part by application of a fluid pressure, which fluid pressure may also assist in expanding the casing 12. The fluid pressure may be varied such as to vibrate one or both of the cone 14 or casing, or to assist in the expansion of the casing, as described in greater detail in our patent application GB 0306774.1 entitled "Hydraulically Assisted Tubing Expansion", the disclosure of which is incorporated herein by reference.

Figure 2:
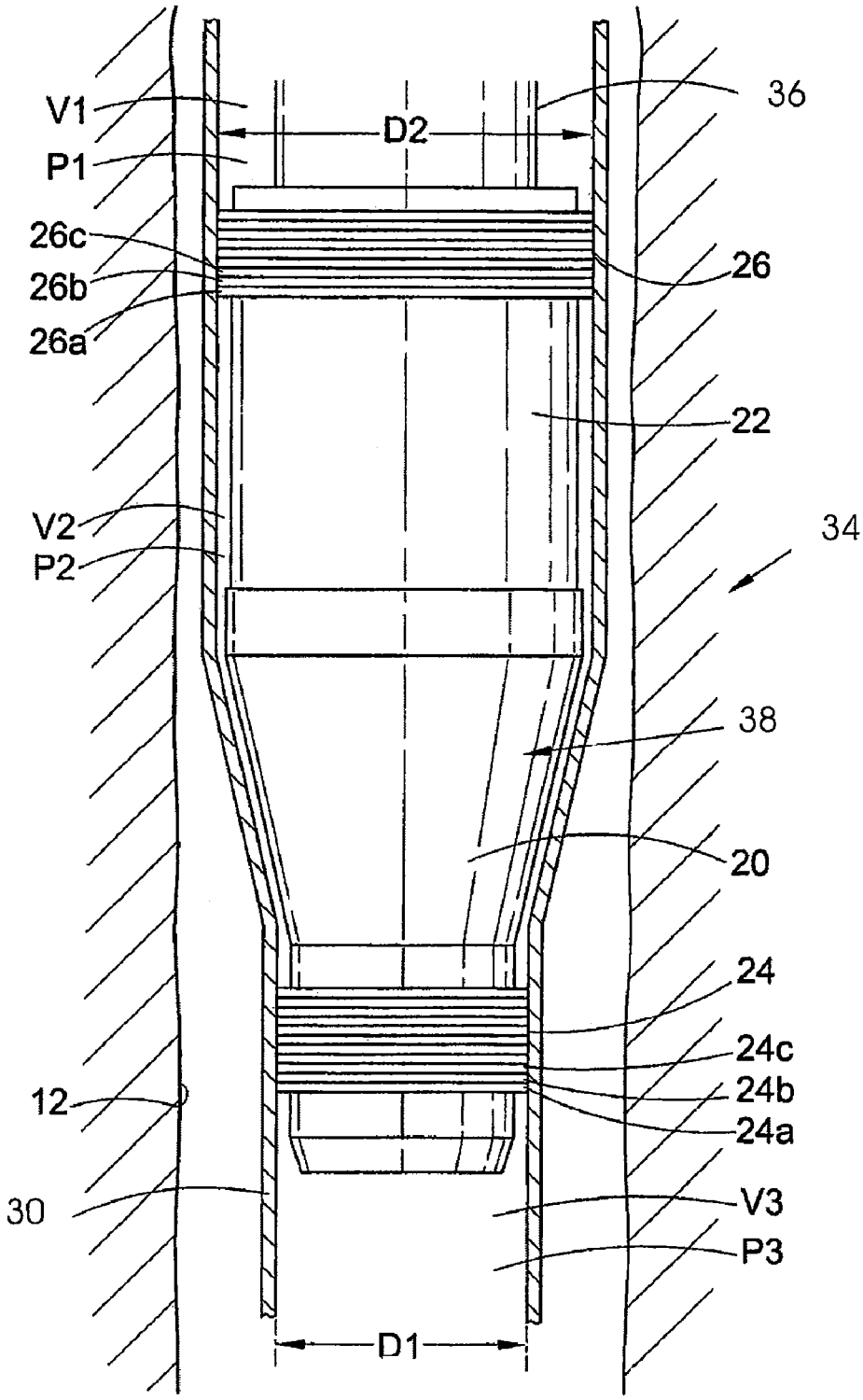
FIG. 2 is a schematic illustration of tubing being expanded downhole in accordance with an embodiment of the present invention.

FIG. 2 of the drawings illustrates a tubing in the form of a bore lining casing 30 located in a drilled bore 12, such as may be utilised to gain access to a subterranean hydrocarbon reservoir. The casing 30 is run into the bore 12 in a smaller diameter first condition, of diameter D1, and is subsequently expanded to a larger second diameter D2.

Expansion of the casing 30 is achieved using expansion apparatus 34 mounted on the lower end of a string of drill pipe 36, which extends to surface. The expansion apparatus 34 comprises a semi-compliant expansion cone 38, that is a cone of relatively hard material which defines an outer expansion surface 20 and which defines a maximum expansion diameter corresponding to the expanded tubing diameter D2. However, the cone 38 is arranged such that the expansion surface may be deflected radially inwardly to a limited extent to accommodate situations where, for example, the casing 30 cannot be expanded to the diameter D2. A variable volume pulse generator 22 is mounted to the cone 38 and is supplied with power via a control line (not shown) that extends to surface.

The volume of fluid surrounding the cone 38 and the oscillator 22 is isolated from the remaining fluid in the casing 30 by seals 24, 26, the leading seal 24 being mounted on the leading end or nose of the cone 38, while the trailing seal 26 is mounted to the trailing end of the oscillator 22. Each seal 24, 26 comprises a plurality of seal members 24*a*, 24*b*, 24*c*, 26*a*, 26*b*, 26*c* as will be described, and in use the seal members 24*a-c*, 26*a-c* permit a degree of leakage thereacross. In this example, each seal member is in the form of a split ring, of a somewhat similar form to a piston ring. Thus, a small volume of fluid may pass between the ends of each seal member. However, the number of seal members provided is such that only minimal leakage occurs past each seal 24, 26. Of course other embodiments of the invention may comprise different forms of seal member, for example porous members or members which are intended to allow a degree of leakage between the seal member surface and the tubing surface.

In use, the volume of fluid V1 in the casing 30 above the seals 26 is at pressure P1. The volume V1 is filled with a relatively high density fluid, resulting in a relatively high hydrostatic pressure above the seals 26. In addition, pumps may be utilised to further increase the pressure above the seals 26.

The volume of fluid V3 beneath the leading seal 24 is isolated from the high density fluid and is at a significantly lower pressure P3 than P1.

The volume of fluid V2 between the seals 24, 26 is maintained at an elevated base pressure P2, which pressure is achieved by means of pumps, which will typically be located on surface, and which communicate with the volume V2 via the drill pipe string 36 and a one-way valve provided in the string 36. The base pressure P2 may be the same as or more than the pressure P1 above the seal 26.

Each individual seal member 24*a*, 24*b*, 24*c*, 26*a*, 26*b*, 26*c* will only maintain a pressure differential which is less than the pressure differential between volumes V1 and V2 or V2 and V3. However, collectively the seal members 24*a-c*, 26*a-c* are effective to maintain the rate of leakage or pressure decay at a relatively low level.

The pressure P2 is selected such that the differential pressure across the wall of the casing 30 is below the yield pressure of the casing 30, for example the pressure P2 may be 70% of the yield pressure. However, operation of the pulse generator 22 creates pressure pulses that exceed the yield pressure of the casing 30, such that the casing 30 will tend to expand when exposed to the pressure pulses.

The weight of the string 36 and the expansion apparatus 34, and the fluid pressure forces acting on the apparatus 34, and thus on the cone 38, also results in a mechanical expansion force being applied to the casing 30 by the cone 38, such that the cone 38 will tend to advance and expand a short length of the casing 30 with each pressure pulse. In particular, the pulsing pressure P2 creates a corresponding differential pressure pulse across the seal 24, and thus creates a pulsing axial force tending to advance the cone 38. Of course this pulsing force will coincide with the maximum pressure, above the casing yield pressure, within the volume V2, when the force required to advance the cone 38, and thus mechanically expand the casing 30, will be at a minimum.

If desired, the pressure P1 above the expansion apparatus 34 may also be pulsed, to apply an additional motive force to the apparatus 34, and to counteract any differential pressure experienced across the seal 26 which might tend to urge the apparatus in the opposite direction.

The cone angle is selected such that the forces acting between the cone surface and the casing 30 will retain the forward travel of the cone 38 following a pressure pulse. In this manner, the casing 30 may be extended in a series of small steps. However, expansion may still take place relatively rapidly. For example, with the pressure between the seals pulsing at 5 hertz, the cone will progress at a rate of approximately six to eight feet per minute.

The presence of fluid around the cone 38 minimises friction between the contacting surfaces of the cone 38 and casing 30, and furthermore the small degree of leakage across the seal members also serves to provide lubrication for movement of the seals 24, 26 through the casing 30.

In addition to the pressure pulses which may be present in the pressure P1 and P2 as noted above, a further pressure variation may be applied to the casing 30 or apparatus 34 with a view to inducing vibration in one or both of the casing 30 or apparatus 34. Such vibration may be utilised to reduce the friction between the apparatus 34 and the tubing 30. This vibration may be the result of further applied fluid pressure pulses, typically of relatively high frequency. Alternatively, the rate of variation of pressure P2 may be selected to provide both expansion and friction-reducing vibration. These features of the invention are more fully described in our application entitled "Tubing Expansion", being filed concurrently herewith.

Figure 3:
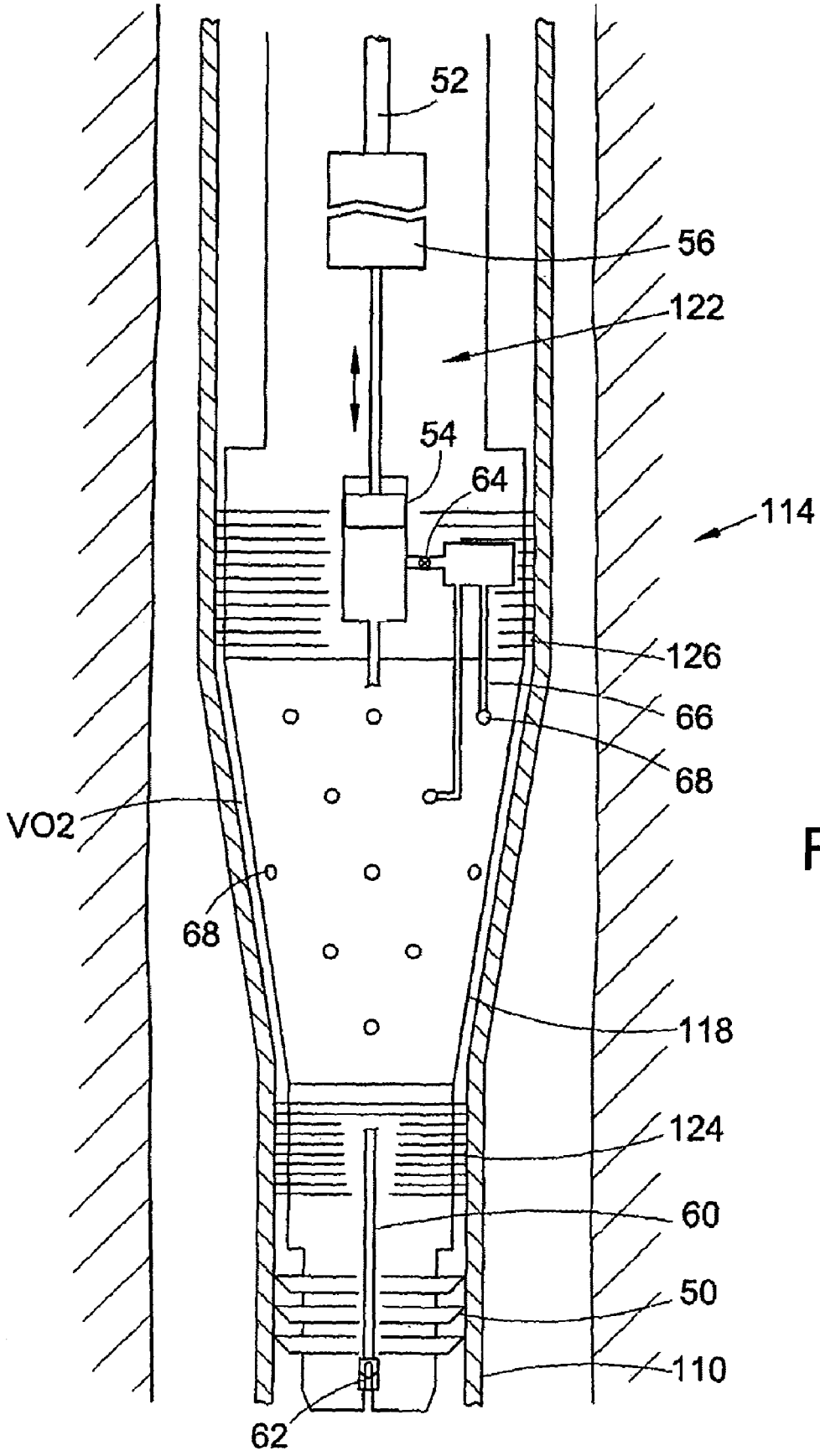
FIG. 3 is a schematic illustration of tubing being expanded downhole in accordance with an embodiment of the present invention.

Reference is now made to FIG. 3 of the drawings, which illustrates expansion apparatus 114 in accordance with a further embodiment of the present invention. The apparatus 114 shares many features with the apparatus 34 described above, and operates in a broadly similar manner.

In addition to the leading and trailing seals 124, 126, swab cups 50 are provided ahead of the leading seal 124, which swab cups 50, in addition to a sealing function, serve to condition the inner surface of the casing 110 ahead of the seal 124, and also assist in stabilising the expansion cone 118.

The oscillator 122 is in the form of reciprocating piston pump, a rotary drive 52 being converted to axial movement of the pump piston 54 by an appropriate transfer arrangement 56, such as those described in WO 02\14028, U.S. Pat. No. 5,042,385, U.S. Pat. No. 5,513,709, the disclosures of which are incorporated herein by reference.

Upward movement of the piston 54 draws fluid from the volume beyond the swab cup 50 into the piston cylinder 58 via a conduit 60 incorporating a one-way valve 62. Downward movement of the piston 54 pumps the fluid from the cylinder 58 through a further one-way valve 64 and then through a plurality of conduits 66 to fluid outlets 68 provided in the cone surface 120.

In use, the fluid pressure above the seal 124, that is the pressure between the seals 124, 126 and also above the trailing seal 126, is maintained at a base pressure corresponding to approximately 70% of the yield pressure of the casing 110, in this example this being around 3000 psi (the yield pressure of the casing 110 is 3700 psi). The oscillator 122 is then operated to pump fluid into the volume V02 between the seals 124, 126 to create short duration 4000 psi pressure pulses within the volume V02, during which the fluid pressure in the small volume around the cone 118 exceeds the casing yield pressure. With each pressure pulse the casing 110 expands by a small degree, in this example, the expansion resulting in a 10 cc increase the volume V02.

A substantially constant weight or force is being applied to the cone 118, for example by provision of a downhole tractor coupled to the string, while the pressure in the volume V02 is pulsed, and at each pulse the cone 118 will advance a short distance to occupy the newly expanded casing 118. The main proportion of the expansion is a result of plastic deformation of the casing 110, while a smaller degree of deformation is elastic, such that the casing 110 will tend to contract to some extent with the decay of the pressure within the volume V02 from the peak pressure produced at each pulse. However, the cone angle is relatively shallow (the cone angle is shown somewhat exaggerated in the Figure) such that the cone 118 will tend to retain any elastic deformation. Thus, following completion of an expansion operation, it may be necessary to apply a tension to the cone 118 while the pressure in the volume V02 is being pulsed in order to remove the cone 118, if this is desired or necessary: in some cases the cone 118 may be left in the casing 110.

As will be apparent to those of skill in the art, the operation of the oscillator 122 combined with the application of weight to the cone 118 will result in relatively rapid expansion of the casing 110.

Those of skill in the art will recognise that the above described embodiments are merely examples of the present invention, and that various modifications and improvements may be made thereto, without departing from the scope of the invention.

The invention claimed is:

1. A method of expanding tubing in a wellbore, the method comprising:

isolating a portion of the tubing containing an expansion device, wherein the isolated portion is located between a pair of seals;

removing fluid from an area of the tubing below the isolated portion;

injecting the fluid into the isolated portion via fluid outlets on a cone surface of the expansion device to establish a base pressure in the isolated portion of tubing, the base pressure creating a differential pressure across a wall of the tubing below the yield pressure of the tubing wall; and introducing pressure pulses into the fluid in the isolated portion to increase the base pressure in excess of the yield pressure of the tubing wall.

2. The method of claim 1, wherein the at least one of the pair of seals is disposed on the expansion device.

3. The method of claim 2, further comprising conditioning an inner surface of the tubing ahead of the at least one seal on the expansion device.

4. The method of claim 3, wherein the inner surface is conditioned by a swab cup.

5. The method of claim 1, further comprising plastically deforming the tubing to a larger diameter when expanding the tubing.

6. The method of claim 1, wherein a driving force of the expansion device remains constant as the expansion device is translated through the tubing.

7. The method of claim 1, wherein at least a major portion of the expansion device is subject to vibration.

8. The method of claim 1, wherein a surface portion of the expansion device is subject to vibration.

9. A method of expanding tubing in a wellbore, the method comprising:

isolating a portion of the tubing by using at least one seal member proximate an end of an expansion device;

pumping fluid from an area below the isolated portion into the isolated portion through ports in a cone surface of the expansion device to establish a base pressure in the isolated portion of tubing, the base pressure creating a differential pressure across a wall of the tubing below the yield pressure of the tubing wall; and applying pressure pulses to the isolated portion of tubing to increase the base pressure in excess of the yield pressure of the tubing wall.

10. The method of claim 9, wherein the tubing is at least partially expanded by fluid pressure.

11. The method of claim 9, wherein the tubing is at least partially expanded by the cone surface of the expansion device.

12. The method of claim 9, wherein the application of pressure pulses creates a vibration in at least one of the tubing and the expansion device.

13. A method of expanding tubing in a wellbore, the method comprising:

isolating a portion of the tubing to be expanded, wherein the tubing is at least partially isolated by a seal member disposed on an expansion device;

applying a base pressure to the isolated portion of tubing by transferring fluid from below the isolated portion into the isolated portion via fluid outlets in a cone surface of the expansion device, the base pressure creating a differential pressure across a wall of the tubing below the yield pressure of the tubing wall; and expanding the isolated portion of tubing by applying pressure pulses to the isolated portion of tubing to increase the base pressure in excess of the yield pressure of the tubing wall.

14. The method of claim 13, further comprising pushing on a workstring connected to the expansion device to translate the expansion device relative to the tubing thereby expanding the tubing.

15. The method of claim 13, further comprising inserting the tubing into the wellbore.

16. The method of claim 13, wherein a driving force of the expansion device remains constant as the expansion device is translated through the tubing.

17. The method of claim 13, further comprising plastically deforming the tubing to a larger diameter when expanding the tubing.

* * * * *